US010011989B2

(12) United States Patent
Pence

(10) Patent No.: US 10,011,989 B2
(45) Date of Patent: Jul. 3, 2018

(54) COMPOSITE BUILDING PANEL

(71) Applicant: Wanessa Sue Pence, Kingman, AZ (US)

(72) Inventor: Wanessa Sue Pence, Kingman, AZ (US)

( * ) Notice: Subject to any disclaimer, the term of this patent is extended or adjusted under 35 U.S.C. 154(b) by 0 days.

(21) Appl. No.: 14/744,418

(22) Filed: Jun. 19, 2015

(65) Prior Publication Data

US 2016/0024789 A1 Jan. 28, 2016

Related U.S. Application Data

(60) Provisional application No. 62/027,671, filed on Jul. 22, 2014.

(51) Int. Cl.

| | |
|---|---|
| ***E04C 1/00*** | (2006.01) |
| ***E04C 2/34*** | (2006.01) |
| ***E04C 2/296*** | (2006.01) |
| ***E04C 2/38*** | (2006.01) |

(52) U.S. Cl.

CPC ..... *E04C 2/34* (2013.01); *E04C 2/296* (2013.01); *E04C 2/3405* (2013.01); *E04C 2/38* (2013.01); *E04C 2/384* (2013.01); *E04C 2002/3488* (2013.01)

(58) Field of Classification Search

CPC . E04C 2/34; E04C 2/3405; E04C 2/38; E04C 2002/3488

USPC ..... 52/309.16

See application file for complete search history.

(56) References Cited

U.S. PATENT DOCUMENTS

| | | | | |
|---|---|---|---|---|
| 3,844,231 | A * | 10/1974 | Peacock | A47B 57/42 108/107 |
| 3,946,528 | A | 3/1976 | Jacobson et al. | |
| 4,094,110 | A | 6/1978 | Dickens et al. | |
| 4,144,296 | A | 3/1979 | Dickens | |

(Continued)

FOREIGN PATENT DOCUMENTS

| | | | |
|---|---|---|---|
| DE | 29921554 | U1 | 3/2000 |
| WO | 2007106613 | A2 | 9/2007 |

(Continued)

OTHER PUBLICATIONS

Thermasteel Corp., Standard Panel Catalog, Oct. 9, 2009, pp. 1-15, http://www.thermasteelcorp.com/stdpanel.pdf.

*Primary Examiner* — Brian E Glessner
*Assistant Examiner* — Joshua K Ihezie
(74) *Attorney, Agent, or Firm* — Venjuris, P.C.

(57) ABSTRACT

Composite building panels and a method for manufacturing a composite building panel are disclosed. A preferred embodiment of a composite building panel comprises a cold rolled steel frame and at least one reinforcing stud. The stud of the preferred embodiment is located within the space defined by the frame and coupled to the frame at the stud's base. The exemplary stud comprises two flanges extending from the base. The flanges of the preferred stud each have a lip at an end distal to the base bent toward each other. Experiments show that the lips on the flanges of the reinforcing studs significantly increase the structural strength of a composite building panel. An alternate preferred embodiment of another composite building panel comprises two boards and at least one reinforcing stud. The exemplary boards face opposite directions, are coupled to each other, and form a space between the two boards.

20 Claims, 3 Drawing Sheets

(56) References Cited

U.S. PATENT DOCUMENTS 4,241,555 A 12/1980 Dickens et al.
4,284,447 A 8/1981 Dickens
4,435,928 A * 3/1984 Huling, III ..... E04B 1/49 52/309.4
4,566,558 A * 1/1986 Link, Jr. ..... E01F 8/007 180/290
4,633,634 A * 1/1987 Nemmer ..... E04B 2/62 52/275
4,641,468 A * 2/1987 Slater ..... E04B 1/12 52/309.4
4,653,718 A 3/1987 Dickens
4,914,879 A * 4/1990 Goldberg ..... E04B 1/14 52/242
5,524,400 A * 6/1996 Schmechel ..... E04B 1/14 52/236.7
5,704,178 A 1/1998 Ciao
5,842,276 A * 12/1998 Asher ..... B26D 1/553 264/142
6,408,594 B1 * 6/2002 Porter ..... E04B 7/22 52/220.1
6,502,357 B1 * 1/2003 Stuthman ..... E04B 2/7448 52/239
6,742,974 B2 * 6/2004 Haire ..... B60P 7/0815 410/104
6,854,230 B2 * 2/2005 Starke ..... E04C 2/521 52/241
7,513,082 B2 * 4/2009 Johnson ..... E04B 2/7412 52/144
7,543,419 B2 * 6/2009 Rue ..... E04C 2/22 52/309.16
8,151,526 B2 * 4/2012 Klein ..... E04B 2/7411 52/1
8,234,833 B2 * 8/2012 Miller ..... E04B 7/22 52/220.7
2001/0011832 A1 * 8/2001 Ehrlich ..... A61B 3/024 296/186.1
2004/0068948 A1 * 4/2004 Wrass ..... E04B 1/90 52/309.7
2005/0204697 A1 9/2005 Rue
2006/0117689 A1 * 6/2006 Onken ..... E04C 2/22 52/309.7
2007/0193169 A1 * 8/2007 Emblin ..... E04B 1/161 52/426
2007/0227086 A1 10/2007 Beavers et al.
2009/0042471 A1 * 2/2009 Cashin ..... B32B 5/18 442/182
2012/0124927 A1 5/2012 Hastings
2014/0305061 A1 * 10/2014 Phillips ..... F41H 5/24 52/438

FOREIGN PATENT DOCUMENTS

WO 2013052997 A1 4/2013
WO 2014000451 A1 1/2014

* cited by examiner

COMPOSITE BUILDING PANEL

CROSS-REFERENCE TO RELATED APPLICATION

The present application claims priority to co-pending U.S. provisional patent application entitled "Composite Building Panel," having Ser. No. 62/027,671, filed on Jul. 22, 2014, which is entirely incorporated herein by reference.

BACKGROUND

Construction with prefabricated building structures saves on-site building time and has been popular since the 19$^{th}$ century for houses, condos, and commercial projects. Building panels have various applications, such as exterior and interior walls, partitions, floors, roofs, and foundation systems. There are different forms of building panels, such as structural insulated panels (SIPs) or prefabricated concrete blocks. Existing structural insulated panels generally comprise an insulating layer sandwiched between two layers of structural boards. Popular materials for the insulating layer include expanded polystyrene foam (EPS), extruded polystyrene foam (XPS), polyisocyanurate foam, polyurethane foam, or composite honeycomb (HSC), while the structural boards may be sheet metal, plywood, cement, magnesium oxide board (MgO), or oriented strand board (OSB).

Even with the structural boards, as a building structure, the strength of a structural insulated panel has always been a major concern for consumers, especially those living in areas where natural disasters such as hurricanes and earthquakes frequently strike. Numerous improvements to building panels have been patented and marketed. Examples of existing reinforcing members used for building panels include thin reinforcing strips and/or wire mesh as disclosed in U.S. Pat. Nos. 4,094,110, 4,241,555, and 4,284,447, rigid thermoplastic sheets as disclosed in U.S. Pat. No. 4,144,296, wire plus concreate beams as disclosed in U.S. Pat. No. 4,653,718, and steel studs as used in ThermaSteel™ wall panels.

Nonetheless, existing inventions and products either do not create building panels that are sufficiently strong to withstand natural disasters or are heavy and/or expensive because of large amounts of metals used. Therefore, a building panel that has high load bearing capabilities while using less expensive materials and having less weight is desired.

SUMMARY

The structure, overall operation and technical characteristics of the present invention will become apparent with the detailed description of preferred embodiments and the illustration of the related drawings as follows.

The invention is incorporated in composite building panels, and a method for manufacturing a composite building panel.

In a preferred embodiment of a composite building panel, the panel comprises a frame and at least one reinforcing stud. The frame and the stud are preferably made of cold rolled steel. The frame is preferably rectangular and defines a space within the frame by the frame's four linear borders. In addition to the sides surrounded by the frame's borders, the space has an inner side and an outer side.

In this embodiment, the reinforcing stud is located within the space at either the inner side or the outer side. The exemplary stud includes a base, a first flange, and a second flange which is parallel to the first flange and substantially symmetrical with the first flange along the base. The base in this embodiment couples the stud, preferably vertically, to the frame. The exemplary base comprises a first side and a second side, from where the first flange and the second flange respectively extend at substantially right angles. The preferred stud thus has a substantially U-shaped, horizontal cross section. In addition, the first flange has a first lip at a first end distal to the base, while the second flange has a second lip at a second end distal to the base, and the first and the second lips extend toward each other.

In this preferred embodiment, the frame has a width of 4 feet and a height of 10 feet, or alternatively in a range of 8 to 12 feet. The preferred reinforcing stud has a height ($H_S$) identical or very close to the height of the frame. The width of the base of the preferred stud ($W_B$) is 3.3750 inches. The two flanges preferably have identical widths ($W_F$) of 1.25" while the lips are both 0.25" wide ($W_L$). All the dimensions listed here are exterior dimensions. For example, $W_B$ is measured from the exterior surfaces of one flange to the other and thus includes the thickness of the flanges. Therefore, the preferred ratio of the width of a lip ($W_L$) to the width of a flange ($W_F$) of an exemplary stud ($W_L$:$W_F$) is 1:5, while a ratio between 1:3 and 1:12 is also acceptable.

Moreover, this embodiment may further comprise two boards/sheets coupled to the frame at the inner and outer sides and closing the space, with the at least one stud inside the space. An insulation layer may also be placed inside the space, preferably when the space is closed by the frame and the boards/sheets. The insulation layer may be a layer of materials for heat and/or sound insulation, such as expanded polystyrene beads, filled or injected into the space.

In another preferred embodiment of the composite building panel, the panel comprises two boards and at least one reinforcing stud. The two boards are substantially parallel to each other and form a space between the two boards. Preferably, the two boards are coupled to each other at one or more edges by any elements known in the art, such as a cap at the top or bottom edges or a tongue-and-groove lap (an attachment element) at the right or left edges. The preferred reinforcing stud is located within the space between the boards and coupled to one of the two boards. In this embodiment, the boards and the stud have structures and dimensions substantially similar or identical to those of the frame and the stud in the aforementioned preferred embodiment.

In addition, this preferred embodiment may comprise more than one reinforcing studs coupled to the two boards, sideway opposite each other to create a completed thermal brake. An alternate embodiment of the composite building panel may further include at least one open raceway for wiring. An embodiment of the building panel may be, and is preferably, made of materials or treated with coatings that are known in the art as being resistant to termite, mold, mildew, fungus, rot, and fire.

Unexpectedly, it was found that, with lips on the flanges of each stud while absent of holes, the load bearing capacities of an embodiment of the composite building panel significantly increase, compared to the other known products. For example, Applicant's experiments show that a 10-foot-high building panel that comprises steel studs with lips and has 7.50 oz of steel per foot (total 40.25 pounds of steel per experimental panel) may bear more ultimate load (24 ga. or pound-per-square-inch) than that (20 ga.) of the control panel that has no lips on its steel studs while weighs more (9 oz of steel per foot, i.e. total 45 pounds of steel per control panel). The details of the panels used in the experiments are listed below:

| | Experimental Panels | Commercial Panels |
|---|---|---|
| Panel Dimensions (W × H × D) | 4' × 10' × 5.5" | 4' × 10' × 5.5" |
| Number of Studs | 4 | 4 |
| Stud Dimensions (W × H × D, i.e. $W_B \times H_S \times W_F$) | 3.375" × 10' × 1.25" | 3-1/2" × 10' × .75" |
| Lip Dimension ($W_L$) | .25" | N/A |
| Lip-Flange Width Ratio ($W_L$:$W_F$) | 1:5 | N/A |
| Average Load (ga) | 24 | 20 |

One object of this invention is to provide a building panel with enhanced load bearing capacity.

Another object of this invention is to provide a building panel with less materials used, and thus less weight and material costs while having the required load bearing capacity.

BRIEF DESCRIPTION OF THE DRAWINGS OR PICTURES

DESCRIPTION OF EMBODIMENTS

Figure 1:
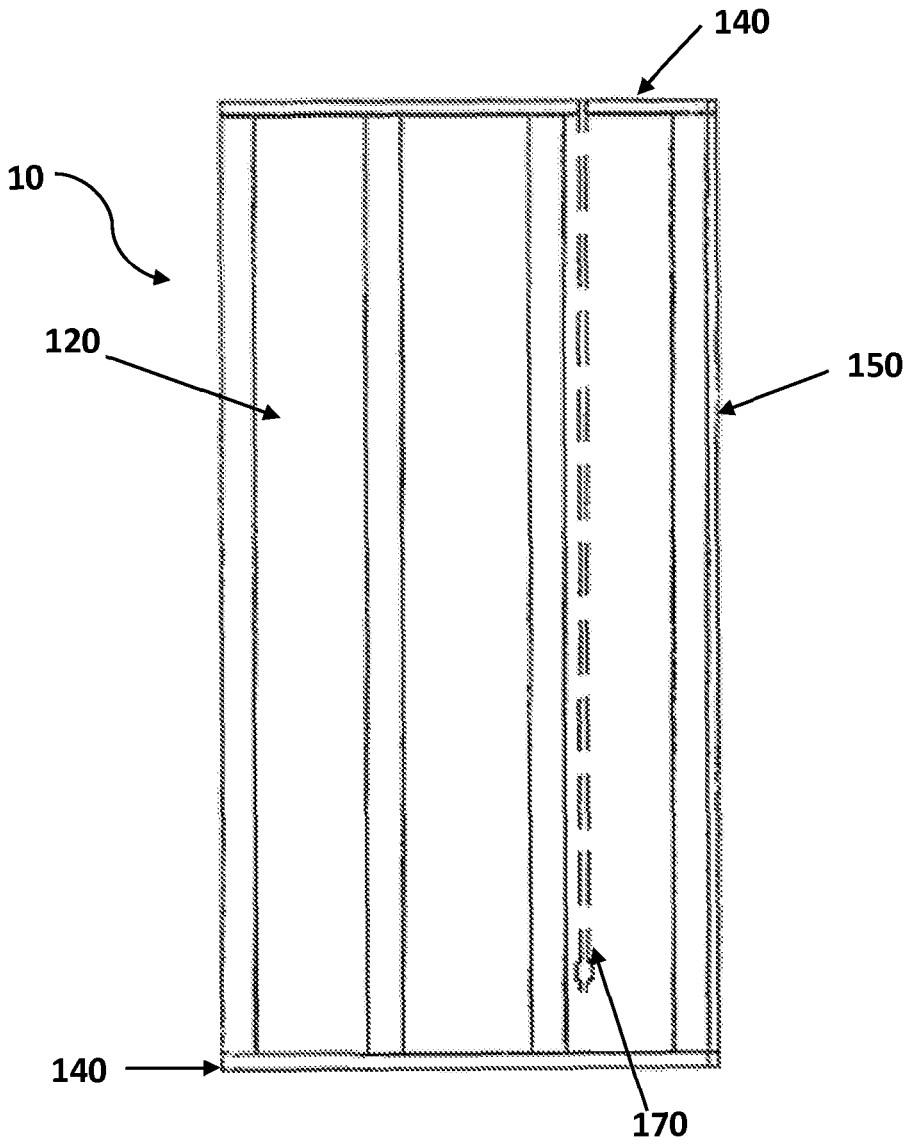
FIG. 1 shows an elevation view of a preferred embodiment of the composite building panel.
Figure 2:
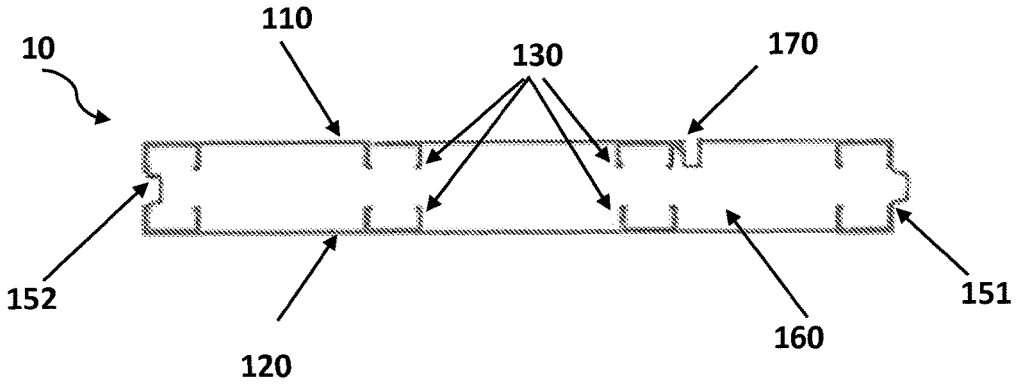
FIG. 2 shows a top, cross-sectional view of the embodiment in FIG. 1.
Figure 3:
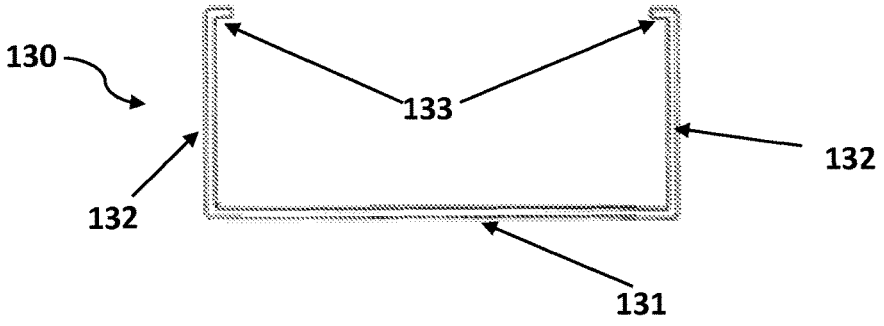
FIG. 3 shows a cross-sectional view of one reinforcing stud of the preferred embodiment.
Figure 4:
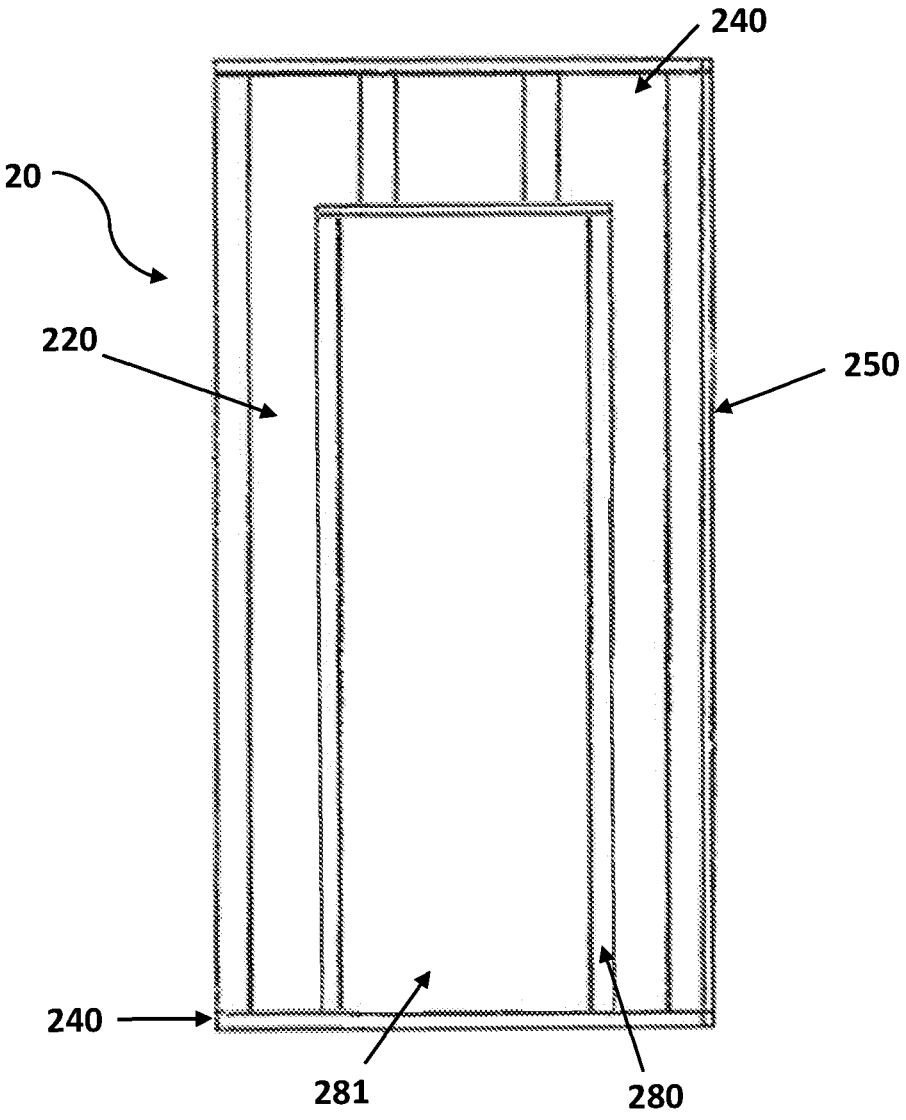
FIG. 4 shows a second preferred embodiment showing an inner frame surrounding an opening configured to accomodate a window or a door.

A preferred embodiment 10 of the composite building panel as shown in FIGS. 1-3 includes an interior board 110, an exterior board 120, and a plurality of vertical, reinforcing studs 130. The interior and exterior boards (110 and 120) are coupled to each other on all sides/edges by caps 140 and plates 150 (an attachment element). A space 160 is formed among the boards 110 and 120, the caps 140, and plates 150, in which the reinforcing studs 130 are respectively coupled to the boards 110 and 120.

The reinforcing studs 130 of the preferred embodiment 10 are cold rolled steel studs. As shown in FIG. 3, each stud 130 comprises a base 131 and two flanges 132. The base 131 is coupled to one of the boards (110 or 120). The flanges 132 extend substantially vertically from the base 131. At the ends distal to the base 131, the flanges 132 are bent toward each other and form lips 133. As aforementioned, experiments show that the lips 133 increase the load bearing capacities of the embodiment 10, even when the embodiment 10 contains less steel.

The interior and exterior boards (110 & 120) in the referred embodiment 10 are respectively 4'×10'×5.5" (width×height×depth) in dimension, and the dimensions of each stud 130 in this embodiment 10 are 3.375"×10'×1.25" (width×height×depth). That is, the width of the base 131 ($W_B$) of an exemplary stud 130, being equal to the stud's width, is 3.375", and the width of a flange 132 ($W_F$), being the same as the stud's depth, is 1.25". With the lips 133 of a preferred stud 130 being 0.25" wide ($W_L$), the lip-flange-width-ratio ($W_L$:$W_F$) of the preferred embodiment 10 is 1:5.

In addition, an embodiment of the invention preferably comprises a coupling mechanism to easily attach to another piece of the building panel. The plates 150 of an embodiment may be designed to have either a male or female attachment (see the tongue-and-groove laps 151 & 152) for coupling to the plates of another embodiment or building structure with an opposite attachment. Other embodiments may adopt shiplaps instead. With or without the plates, embodiments may also be attached to one another or other building structures by conventional ways, such as fasteners like self-tapping screws and adhesives.

Furthermore, the preferred embodiment 10 has a vertical, open raceway 170 on its interior board 110 for holding and protecting electric wires. Although not shown in the drawings, the preferred embodiment 10 may additionally have an insulating layer for thermal, acoustic, fire, or impact insulation purposes such as mineral wool and urethane foam as stated above placed/filled in the space 160 between the boards 110 and 120. Some embodiments may further comprise an opening for doors or windows. Typically, embodiments may be made of materials that are resistant to mold, mildew, termite, fungus, fire or rot while other embodiments may be coated in whole or partially with such materials.

An alternate preferred embodiment may have a rectangular, cold rolled steel frame and a plurality of reinforcing studs as the studs 130 in FIGS. 1-3. Like how the studs 130 are arranged in FIG. 2, the reinforcing studs in this embodiment are coupled to the frame while being sideway opposite each other within a space defined by the frame. The embodiment may in addition have a second (or inner) frame for receivably retaining a door or a window. The second/inner frame is coupled to the frame and located inside the space.

The embodiment with a frame may additionally comprise two boards or sheets, like the boards 110 & 120 in FIG. 1, that are coupled to the frame at the inner and outer side and closing the space inside the frame. Moreover, an insulation layer may be added inside the space, preferably when the space is closed by the frame and boards/sheets. Also, if the embodiment has a second/inner frame for a door or window, the boards would have an opening for accommodating the second/inner frame.

While the invention has been described by means of specific embodiments, numerous modifications and variations could be made thereto by those ordinarily skilled in the art without departing from the scope and spirit disclosed herein. For example, an embodiment may have a reinforcing stud coupled to a board at any direction—vertically, horizontally, diagonally, and so forth. The boards in another embodiment may be coupled together by alternate structures or means known in the art, such as screws, bolts, spacers, and non-toxic adhesives. The reinforcing studs may be made of (partially or in whole) alternate materials that are known to provide sufficient support to the boards, such as carbon fiber reinforced polymer (CFRP).

The invention claimed is:

1. A composite building panel comprising:

a. a vertical frame defining an empty space, the frame comprising:

i. an inner side, an outer side, a left side, a right side, ii. a horizontal frame member located at one of a top edge and a bottom edge of the panel and extending from the left side to the right side, and iii. a vertical frame member coupled to the horizontal frame member at one of the left side and the right side b. at least one reinforcing steel stud located within the space, extending vertically at one of the inner side and the outer side, the stud comprising:
   i. a base comprising a first side and a second side, the base being configured to couple the stud to the frame and be in direct contact with the horizontal frame member,
   ii. a first flange comprising a first lip, the first flange extending from the first side of the base with the first lip distal to the base, and
   iii. a second flange comprising a second lip, the second flange extending from the second side of the base with the second lip distal to the base,
   wherein the first lip and the second lip extend toward each other and wherein the first lip and the first flange respectively have widths forming a width ratio of approximately 1:5, and wherein the second lip and the second flange respectively have widths forming a width ratio of approximately 1:5;
c. a steel mass per foot; and
d. a load bearing capacity at least as great as that of a control panel with no lipped stud when the steel mass per foot is 16% less than that of the control panel.

2. The composite building panel in claim 1 further comprises an insulating layer located in the space.

3. The composite building panel in claim 2, wherein the insulating layer further comprises an attachment member selected from a group consisting of a tongue, a groove, a fastener, an adhesive, and combinations thereof.

4. The composite building panel in claim 1 further comprises a second stud located in the space, facing opposite to the stud, and coupled to the frame at a second one of the inner side and the outer side.

5. The composite building panel in claim 1 further comprises an inner frame located inside the space, coupled to the frame, and configured to receivably retain a door or a window.

6. The composite building panel in claim 1, wherein the frame further comprises an attachment member selected from a group consisting of a tongue, a groove, a fastener, an adhesive, and combinations thereof.

7. The composite building panel in claim 1, wherein the vertical frame member is a second stud.

8. A composite building panel comprising:
a. a vertical frame having:
   i. an interior side, an exterior side, a left side, a right side,
   ii. a horizontal frame member located at one of a top edge and a bottom edge of the panel and extending from the left side to the right side, and
   iii. a vertical frame member coupled to the horizontal frame member at one of the left side and the right side;
b. an interior board coupled to the vertical frame at the interior side;
c. an exterior board coupled to the vertical frame at the exterior side and being substantially parallel to the interior board;
d. an empty space formed among the vertical frame, the interior board, and the exterior board;
e. at least one reinforcing steel stud located in the space, extending vertically, the stud having:
   i. a base comprising a first side and a second side, the base being configured to couple the stud to the vertical frame and one of the interior and exterior boards and be in direct contact with the horizontal frame member,
   ii. a first flange having a first lip, the first flange extending from the first side of the base with the first lip distal to the base, and
   iii. a second flange having a second lip, the second flange extending from the second side of the base with the second lip distal to the base,
   wherein the first lip and the second lip extend toward each other and wherein the first lip and the first flange respectively have widths forming a width ratio of approximately 1:5, and wherein the second lip and the second flange respectively have widths forming a width ratio of approximately 1:5;
f. a steel mass per foot; and
g. a load bearing capacity at least as great as that of a control panel with no lipped stud when the steel mass per foot is 16% less than that of the control panel.

9. The composite building panel in claim 8 further comprises a first ratio of a width of the first lip to a width of the first flange and a second ratio of a width of the second lip to a width of the second flange, the first ratio and the second ratio being in a range of approximately 1:5 to 1:12.

10. The composite building panel in claim 8 further comprises a second stud located in the space, facing opposite to the stud, and coupled to a second one of the interior and exterior boards.

11. The composite building panel in claim 8 further comprises an opening through the interior board and the exterior board.

12. The composite building panel in claim 8, wherein the horizontal frame member is a cap configured to couple the interior board to the exterior board.

13. The composite building panel in claim 8 further comprises an attachment element configured to couple the interior board to the exterior board and attach the composite building panel to a building structure.

14. The composite building panel in claim 13, wherein the attachment element further comprises an attachment member selected from a group consisting of a tongue, a groove, a fastener, an adhesive, and combinations thereof.

15. The composite building panel in claim 8, wherein the interior board further comprises an open channel configured to hold a wire.

16. The composite building panel in claim 8 further comprises an insulating layer located in the space.

17. A composite building panel comprising:
a vertical frame defining an empty space having an inner side, an outer side, and two vertical edges, the frame comprising:
a. an elongated top frame member extending horizontally;
b. an elongated bottom frame member extending horizontally;
c. at least one first reinforcing steel stud located at one of the two vertical edges, extending vertically, the first reinforcing stud comprising:
   i. a base comprising a first side and a second side, the base being configured to couple the stud to the top and bottom frame members at one of the inner and outer sides and be in direct contact with the top and bottom frame members,
   ii. a first flange comprising a first lip, the first flange extending from the first side of the base with the first lip distal to the base, and
   iii. a second flange comprising a second lip, the second flange extending from the second side of the base with the second lip distal to the base,
   wherein the first lip and the second lip extend toward each other and wherein the first lip and the first flange respectively have widths forming a width ratio of approximately 1:5, and wherein the second lip and the second flange respectively have widths forming a width ratio of approximately 1:5;

d. at least one second reinforcing steel stud located at a second one of the inner side and the outer side and at a second one of the two vertical edges, facing opposite to the at least one first stud, and coupled to the top and bottom frame members, wherein the at least one first stud and the at least one second stud are located at opposite vertical edges of the frame;

e. a steel mass per foot; and f. a load bearing capacity at least as great as that of a control panel with no lipped stud when the steel mass per foot is 16% less than that of the control panel.

18. The composite building panel in claim 17 further comprises an inner frame located inside the space, coupled to the frame, and configured to receivably retain a door or a window.

19. The composite building panel in claim 17 further comprises an insulating layer located in the space.

20. The composite building panel in claim 19, wherein the insulating layer further comprises an attachment member selected from a group consisting of a tongue, a groove, a fastener, an adhesive, and combinations thereof.

* * * * *